US005404407A

United States Patent [19]

Weiss

[11] Patent Number: 5,404,407

[45] Date of Patent: Apr. 4, 1995

[54] PROGRAMMABLE HEARING AID UNIT

[75] Inventor: Hans-Joachim Weiss, Nuremberg, Germany

[73] Assignee: Siemens Audiologische Technik GmbH, Erlangen, Germany

[21] Appl. No.: 268,663

[22] Filed: Jun. 29, 1994

Related U.S. Application Data

[63] Continuation of Ser. No. 100,372, Aug. 2, 1993, abandoned.

[30] Foreign Application Priority Data

Oct. 7, 1992 [DE] Germany ..... 42 33 813.1

[51] Int. Cl.[6] ..... H04R 25/00

[52] U.S. Cl. ..... 381/68; 381/23.1; 381/68.7; 381/69

[58] Field of Search ..... 381/68, 68.2, 68.6, 381/69, 69.2, 68.7, 23.1; 200/2 R, 52 R; 439/188, 489

[56] References Cited

U.S. PATENT DOCUMENTS

| | | | |
|---|---|---|---|
| 4,425,481 | 1/1984 | Mansgold et al. | 179/107 |
| 4,548,082 | 10/1985 | Engebretson et al. | 381/68 |
| 5,188,540 | 2/1993 | Haertl et al. | 439/500 |

FOREIGN PATENT DOCUMENTS

| | | | |
|---|---|---|---|
| 0311233A2 | 4/1989 | European Pat. Off. | H04R 25/00 |
| 2024853 | 7/1971 | Germany | H01H 13/70 |
| 3032311A1 | 3/1981 | Germany | H04R 25/00 |
| 3501448A1 | 8/1985 | Germany | H04R 25/00 |
| 3633722C1 | 11/1987 | Germany | H04R 25/00 |
| 8800629 U | 6/1989 | Germany | H04R 25/00 |
| 3913789A1 | 10/1990 | Germany | H01H 19/36 |
| 4031132A1 | 8/1991 | Germany | H04R 25/00 |
| 4109306C1 | 7/1992 | Germany | H04R 25/00 |

*Primary Examiner*—Curtis Kuntz
*Assistant Examiner*—Sinh Tran
*Attorney, Agent, or Firm*—Hill, Steadman & Simpson

[57] ABSTRACT

A programmable hearing aid is provided with a programming socket. A space-saving arrangement of switch elements is provided wherein a switch element for switching the hearing aid on/off, an MTO switch, a volume control, a tone control, a situation switch or the like can be introduced into the programming socket that is free except during the programming event.

9 Claims, 3 Drawing Sheets

PROGRAMMABLE HEARING AID UNIT

This is a continuation of application Ser. No. 08/100,372, filed Aug. 2, 1993, abandoned.

BACKGROUND OF THE INVENTION

The invention is directed to a programmable hearing aid unit having function parts, such as current source, microphone, amplifier unit, earphone as well as a programming circuit arranged in a housing, the latter being connectable to electrical contacts at an external data generating means, particularly an external programming unit, via a socket at the housing side for being supplied with setting data. DE-C-41 09 306, corresponding to U.S. Pat. No. 5,188,540 discloses a hearing aid of this type.

DE-U-88 00 629 discloses an electrical hearing aid unit that comprises a socket part having electrical tip jacks that are conductively connected to a PC motherboard or the like and that are connectable to the external data generating means with mating electrical plug pins of a plug part. A plug part of the external data generating means can be introduced into the socket part provided with tip jack contacts or wiper contacts for the purpose of setting the transfer or transmission functions of the hearing aid. In addition to a programming socket, a volume control, what is referred to as an MTO switch (for switching the hearing aid to a microphone mode, for switching over to a telephone mode/induction coil mode and for switching the hearing aid means to an off/zero position), as well as an actuator or regulator switch for setting the tone control means or the like are also provided at the housing of the known hearing aid.

EP-A-0 064 042 corresponding to U.S. Pat. No. 4,425,481 discloses a hearing aid wherein the parameters of a plurality of different ambient situations are stored in a memory. By actuating a switch, for example, the first group of parameters is called in and, via a control unit, controls a signal processor inserted between microphone and earphone, this signal processor then setting the first transfer or transmission function intended for a provided environment. Via what is referred to as a situation switch, all programmed transfer or transmission functions can be successively called in by the hearing aid wearer until the transfer or transmission function which suits the hearing aid wearer has been found. On the other hand, an automatic adaptation is also provided when the user moves, for example, from a noisy environment into a quiet environment or vice versa. For programming the memory of the hearing aid, the hearing aid is connected to an external programming unit via an electrical line.

DE-A-30 32 311 discloses a hearing aid having a reception part for receiving wirelessly transmitted signals, whereby the hearing aid is provided with externally accessible contact elements such that the reception part comprises at least one receiver electrode and contact elements which can be brought into engagement with the contact elements of the hearing aid in order to keep the receiver electronics in electrical communication with the circuit of the hearing aid. The contact elements of the hearing aid are thus designed as sockets and the contact elements of the receiver part are designed as plug pins. Additional switch elements are provided at the housing of the hearing aid for switching the hearing aid on and off as well as for controlling volume.

In the programmable hearing aid disclosed by DE-A-40 31 132, the programming contacts are optionally utilized as an audio input. For that purpose, an electronic switch is provided which is controlled by a memory module. The switch is switched on or off by transmitting specific data signals to the memory module.

Given hearing aid means to be worn at the head, particularly behind-the-ear units but quite specifically given extremely small hearing aids to be worn in the ear or in the auditory canal, there is only a small amount of space available for the arrangement of the operating and switch elements, etc.

SUMMARY OF THE INVENTION

It is an object of the invention to create a hearing aid of the type initially cited that is distinguished by a space-saving arrangement of the switch elements.

With the present invention, the socket or programming socket at the housing of the hearing aid can be employed for the arrangement and acceptance of at least one switch element.

In an advantageous development of the invention, a switch element for switching the unit on or off, an MTO switch, a volume control, and a tone control switch or the like can be introduced into the programming socket that is free except during the programming event. In the present application, a variable control element such as a potentiometer for volume or tone control is intended to be included in the definition of the term "switch element".

According to the invention, the socket or the like which is present for transmitting setting data from a programming means to the hearing aid and/or for calling program data in from the hearing aid can be utilized for a space-saying arrangement accommodating one or more switch elements after the conclusion of the data transmission, and thus during use of the hearing aid. Instead of a separate arrangement of the switch elements at the hearing aid housing next to the socket that is free during use of the hearing aid, at least one of the switch elements, for example an on/off switch, an MTO switch, a volume control, a tone control or the like can be introduced into the socket. When the socket is required for programming the hearing aid, the switch element can simply be taken out of the socket. Programming contacts of the socket can thereby be potentially employed for the switch connection, and the socket connection can comprise switch contacts in addition to the programming contacts. At least one additional, discrete switch at a different location can be eliminated with the employment of the existing programming socket as a base for a switch element.

In an advantageous embodiment and for simple actuation, a push-button switch or toggle switch can particularly be introduced into the socket as a switch element.

In hearing aid units that require an additional situation switch operable by the hearing aid wearer for adaptation of the transfer or transmission function to various ambient situations, for example noisy environments, street noise, quiet surroundings, etc., the invention enables the attachment of this situation switch to the socket.

Further advantages and details of the invention derive from the following description of exemplary embodiments with reference to the drawings and in combination with the claims.

DESCRIPTION OF THE PREFERRED EMBODIMENTS

Figure 1:
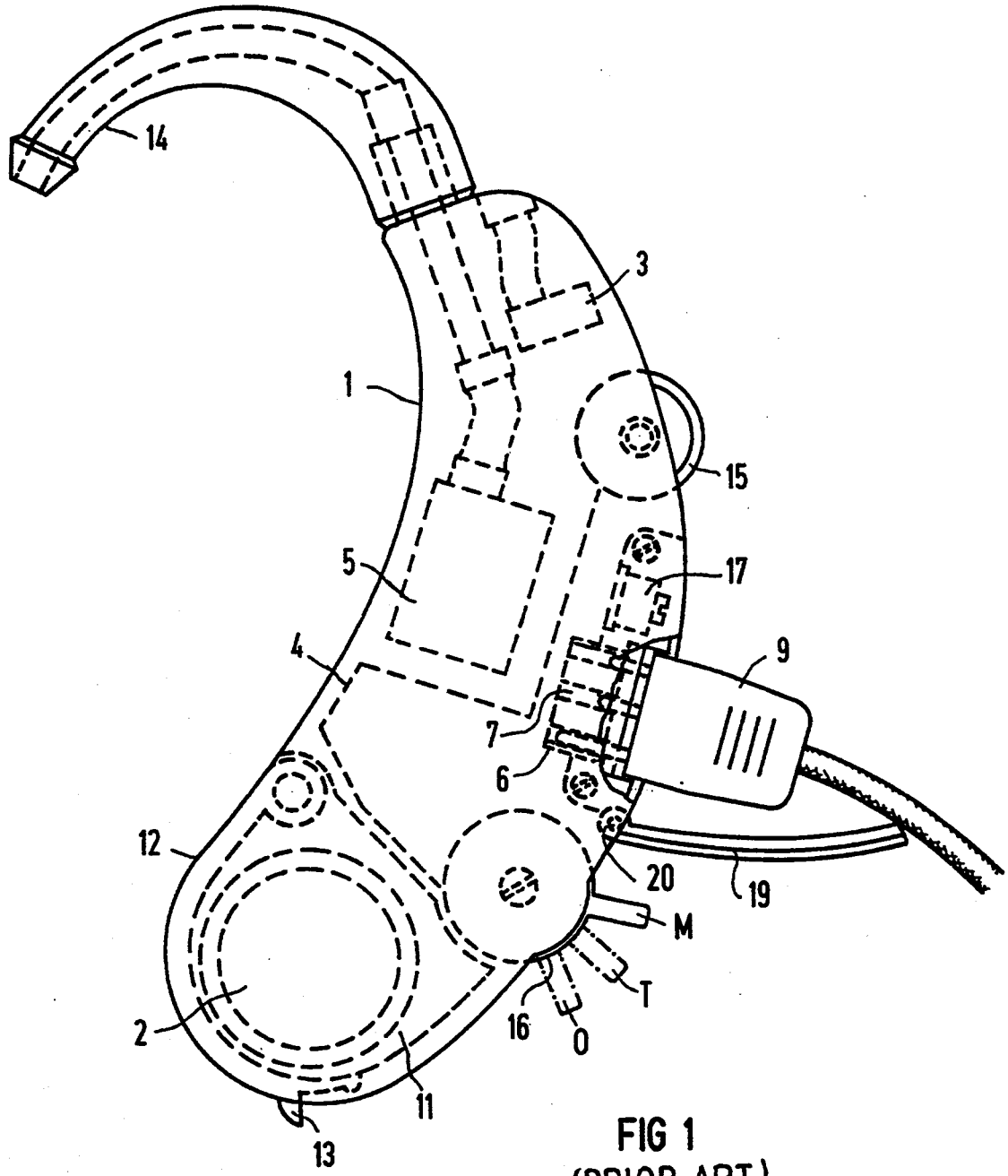
FIG 1 (PRIOR ART)
FIG. 1 is a programmable hearing aid unit to be worn behind the ear which, in conformity with the prior art, has a programming socket as well as switch elements at the housing.

FIG. 1 shows a known hearing aid unit to be worn behind the ear comprising a housing 1 that, for example, is composed of shells. A compartment 11 for a current source, for example a battery 2, is situated at one end of the housing 1. For that purpose, the battery compartment 11 contains a battery drawer 12 to be opened and a manipulator 13. A carrying hook 14 is provided at the other end of the housing. A hose conduit (not shown) leads from the carrying hook to an ear button which is introduced into the auditory canal when the hearing aid unit is being worn. A small wheel 15 for setting the volume as well as switch 16 for the switch position T in which the hearing aid unit is connected, for example, to a telephone coil, a switch position O for turning the means off, and a switch position M for turning the means or the microphone of the means on are located at the convexly outwardly arced back side of the unit.

The most critical component parts or function parts of the hearing aid unit are, as known, the microphone 3, an amplifier unit 4 having a programmable circuit, an earphone 5 as well as control elements 17, for example for setting the tone control. The behind-the-ear unit further comprises a socket part 6 having electrical programming contacts 7 that is electrically connected to its programming circuit. For being supplied with the setting data, the hearing aid unit is connected to an audiometer (not shown) in that the programming plug 9 thereof has its electrical plug pins electrically coupled to the socket part. After the conclusion of the programming event and after removal of the plug part 9, the socket 6 can be closed by a flap 19 which is articulated to the housing 1 with a hinge 20.

Figure 2:
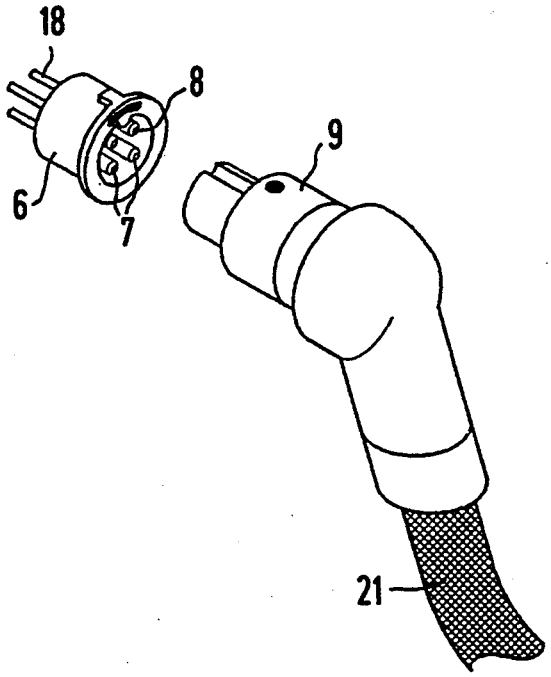
FIG. 2 is an exploded view of a socket and of a corresponding plug connection of a programming cable or of an audio terminal.

FIG. 2 shows a socket 6 built into the hearing aid unit of the invention for the programming thereof, being shown together with its electrical connections 18 and programming contacts 7 as well as an additional switch contact 8. For example, this socket can be coupled to a programming plug 9 of a programming cable 21 of an external programming unit for programming the hearing aid. On the other hand, the socket can also be employed for the connection of an audio adapter for an audio terminal.

Figure 3:
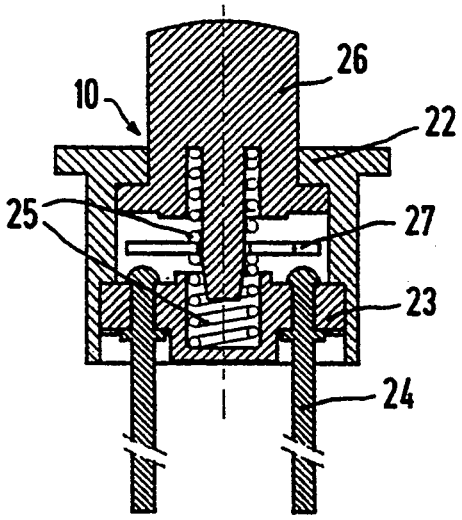
FIG. 3 is a section through a switch element, for example in the form of a push button, pluggable into the programming socket of a hearing aid means according to the invention.
Figure 4:
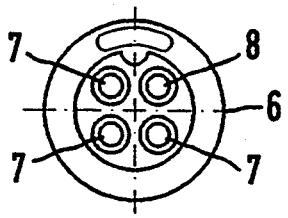
FIG. 4 is a plan view onto the programming and switch contacts of a socket according to FIG. 2.

According to the invention, the socket 6 is also provided for the acceptance of a switch element 10, for example, a push button according to FIG. 3. After the hearing aid has been programmed with the function data, then the existing programming socket 6 is employed as a base element for a switch element 10 in that the switch element 10 can be introduced into the socket. The switch element 10 can be designed as an on/off switch, as an MTO switch, as a situation switch, as a tone control, as a volume control or as a multi-function switch as well. The illustrated push button 10 that can be introduced into the socket 6 and removed from the socket 6 is composed, for example, of a switch housing 22 having a PC motherboard 23 with contact pins 24, a switch spring 25, an actuation element 26, and a contact bridge 27.

Although various minor changes and modifications might be suggested by those skilled in the art, it will be understood that I wish to include within the scope of the patent warranted hereon all such changes and modifications as reasonably come within my contribution to the art.

I claim as my invention:

1. A programmable hearing aid unit, comprising:
   function parts including a current source, a microphone, an amplifier unit, an earphone, and a programming circuit arranged in a housing;
   electrical contacts for connecting the programming circuit to an external programming unit via a programming socket at the housing, said external programming unit supplying setting data to the programming circuit; and
   the programming socket having both programming contacts and a switch contact in addition to and separate from said programming contacts said programming socket accommodating a switch element when a programming plug is not plugged in the programming socket, said switch element connecting to said switch contact when accommodated in the programming socket.

2. A hearing aid unit according to claim 1 wherein the switch element is designed as one of the elements selected from a group consisting of an on/off switch, MTO switch, situation switch, tone control, volume control, and multi-function switch.

3. A hearing aid unit according to claim 1 wherein said switch element comprises a situation switch for setting transfer functions of the hearing aid unit.

4. A hearing aid unit according to claim 1 wherein said switch element comprises a push button.

5. A hearing aid unit according to claim 1 wherein said switch element comprises a toggle switch.

6. A hearing aid unit according to claim 1 wherein said switch element comprises a rotary switch.

7. A hearing aid unit according to claim 1 wherein said switch element comprises a potentiometer.

8. A hearing aid unit according to claim 1 wherein said programming socket comprises a base for said switch element.

9. A programmable hearing aid unit, comprising:
   a housing having electronic circuitry for the hearing aid unit contained therein including a programming circuit;
   a socket on the housing connected to the programming circuit; and
   said socket receiving being adapted to receive a cable from an external programming unit which supplies setting data for the programming circuit or alternatively said socket accommodating a switch element which is plugged directly into the socket, said socket having programming contacts for connecting to said cable and a switch contact in addition to and separate from said programming contacts, said switch contact for connecting to said switch element to provide functioning thereof.

* * * * *